US005947846A

United States Patent [19]

Craig

[11] Patent Number: 5,947,846

[45] Date of Patent: Sep. 7, 1999

[54] HOCKEY GOAL—"THE JUDGE"

[76] Inventor: Duncan R. Craig, 40 Robin La., Guilford, Conn. 06437

[21] Appl. No.: 08/952,396

[22] PCT Filed: Mar. 20, 1997

[86] PCT No.: PCT/US97/04429

§ 371 Date: Nov. 19, 1997

§ 102(e) Date: Nov. 19, 1997

[87] PCT Pub. No.: WO97/38762

PCT Pub. Date: Oct. 23, 1997

Related U.S. Application Data

[60] Provisional application No. 60/015,766, Apr. 16, 1996.

[51] Int. Cl.[6] ..... A63B 63/00

[52] U.S. Cl. ..... 473/478; 473/477; 273/127 B

[58] Field of Search ..... 473/471, 478, 473/980, 477, 570; 273/400, 127 B, 371

[56] References Cited

U.S. PATENT DOCUMENTS

| | | |
|---|---|---|
| 3,979,120 | 9/1976 | Dietrich . |
| 4,026,554 | 5/1977 | Karkosa . |
| 5,564,698 | 10/1996 | Honey et al. . |
| 5,615,880 | 4/1997 | Booth et al. . |

*Primary Examiner*—Mark S. Graham

*Attorney, Agent, or Firm*—Kane, Dalsimer, Sullivan, Kurucz, Levy, Eisele and Richard, LLP

[57] ABSTRACT

A score-indicating hockey goal assembly provides a television-viewable visual signal when a score is indicated.

7 Claims, 2 Drawing Sheets

HOCKEY GOAL— "THE JUDGE"

CROSS-REFERENCE TO RELATED APPLICATION

This is a 371 of PCT/US97/04429 filed Mar. 20, 1997. This application claims the priority of my U.S. Provisional Application Ser. No. 60/015,766 filed Apr. 16, 1996.

BACKGROUND OF THE INVENTION

1. Field of Invention

The invention relates to sporting equipment and more particularly to a hockey goal-frame.

2. Brief Description of Related Art

Hockey, particularly ice hockey, has become increasingly popular as a spectator sport, particularly for viewing on televised programs. However, because the hockey puck is relatively small, colored black and fast travelling, it is sometimes difficult for the observer to follow. This is particularly a difficulty when the puck is delivered to the goal. An observer may not be able to see that a goal has been scored. This is especially so in hockey play, where the goal tender characteristically blocks the goal mouth and may further obscure a view of the scoring.

The hockey goal-frame of the present invention provides a visual indication to spectators, when a goal is scored and is particularly observable to a television viewer.

SUMMARY OF THE INVENTION

The invention comprises a regulation size, score indicating, hockey goal assembly, which comprises;

an open frame defining the goal opening and having an inverted "U" shape with a cross-bar between two downwardly projecting, parallel legs;

the parallel legs each having a first end and a second end, the first ends being integral to the cross-bar and the second ends integral to means for support on a ground surface;

means for support on a ground or ice surface;

said frame housing television viewable signal means for indicating a goal scored; and means for activating the signal means.

The term "hockey" as used herein includes ice hockey, in-line (roller) hockey and field hockey. These sports generally employ a goal tender who blocks entry to the goal itself.

The assembly of the invention is useful to indicate to spectators when a goal has been scored in a hockey game, particularly to improve the indication given to a televised game viewer.

DETAILED DESCRIPTION OF THE PREFERRED EMBODIMENTS OF THE INVENTION

Those skilled in the art will gain an appreciation of the invention from the following description of preferred embodiments, when read in conjunction with a viewing of the accompanying drawings of FIGS. 1–5, inclusive.

Figure 1:
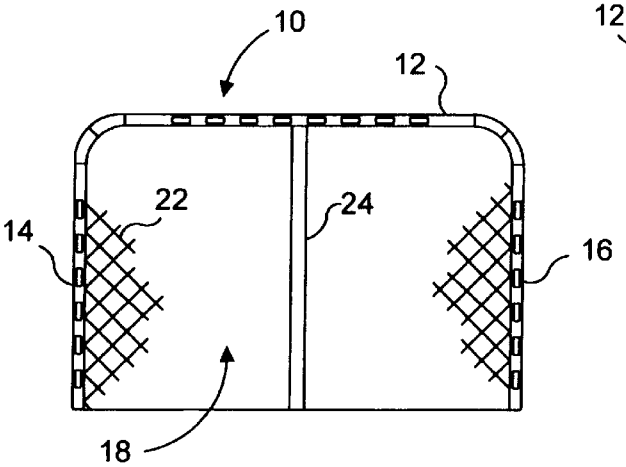
FIG. 1 is a front elevation of a preferred embodiment goal of the invention.

FIG. 1 is a front elevation of a preferred embodiment hockey goal assembly 10 of the invention.

The assembly 10 is a stable, conventional hockey goal assembly comprising a frame 12 having an inverted "U" shape, the free ends of the legs 14,16 being adapted to stand freely on a ground or ice support means (not shown in FIG. 1). The frame 12 defines the goal opening or mouth 18 for receiving a hockey puck during play. A regulation size goal for ice hockey may have a mouth 18 with dimensions of six feet wide and 4 feet high. The frame 12, legs 14,16 and ground support are a unitary, one-piece, tube construction. Advantageously, the frame 12 is fabricated from lightweight tubular components having the necessary strength to function as a goal assembly. For example, it may be made of tubular aluminum, tubular steel or steel alloys or synthetic polymeric resins such as polyvinyl chloride, polycarbonate, polyurethane, polyacrylics or the like. A puck retaining net 22 shown fragmented in FIG. 1, covers the goal assembly 10 except for mouth 18. The net 22 may be any conventional puck retaining net conventionally employed in like goal assemblies and need only be draped over the goal assembly 10 structure, connected to the frame 12 by any conventional means such as hooks, tabs or the like. Net support member 24 at the back of the assembly 10, distal to mouth 18, aids in the support of net 22.

Figure 2:
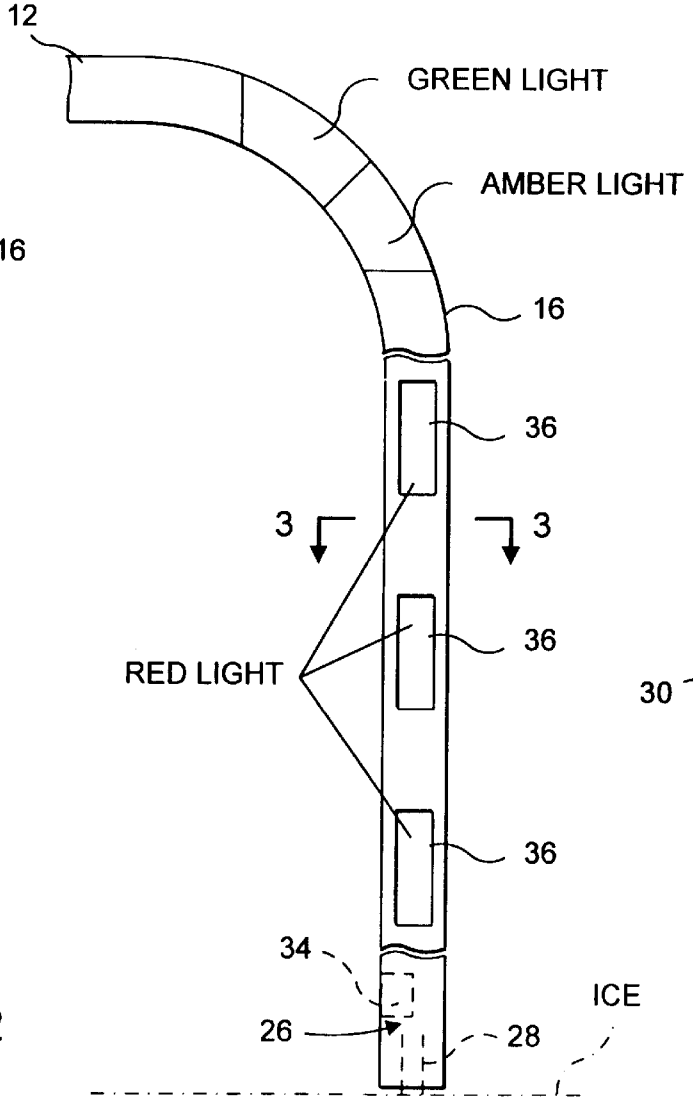
FIG. 2 is a front elevation of an enlarged fragmented portion of the open frame defining the goal opening, as shown in FIG. 1, partially cut-way to show internal components.
Figure 3:
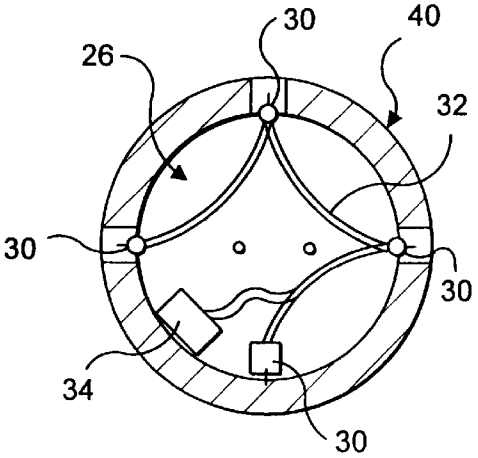
FIG. 3 is a view along lines 3—3 of FIG. 2.
Figure 4:
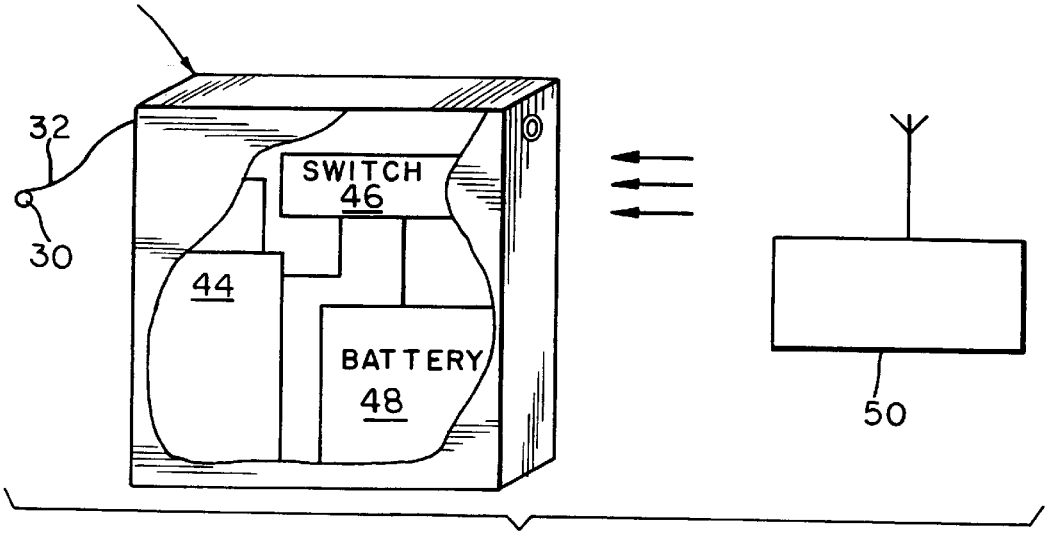
FIG. 4 is a view-in-perspective of an embodiment device of the invention, partially cut-away to show internal components and its schematic relationship to a signal transmitter.

FIG. 2 is a front elevation of an enlarged fragmented portion of the frame 12 defining the goal opening 18, including a portion of the cross-bar and one of the parallel legs (leg 16). The tube frame 12 defines an interior hollow 26 (see FIG. 3, a view along lines 3—3 of FIG. 2). Within hollow tube 26 there may be inserted and housed a plurality of electric lamps 30 joined by an electrical conductor circuit 32 to a power source and switch means module 34 in a base portion of leg 14 or 16. Advantageously, halogen lamps or strobe lamps are used for visual effect. When energized, the lamps 30 project light, through tube apertures 36, in the exterior walls 40 of frame 12. Alternatively, a fresnel lens can be positioned in aperture 36 to enhance the projection of light. Advantageously, the projected light is of a color and intensity viewable on a television receiver. Red color is preferred. The module 34 is shown more particularly in FIG. 4, a view-in-perspective of module 34 cut-away partially to show internal components. The module 34 houses a radio receiver 44 which, upon receiving a transmitted radio signal will close switch 46, thereby connecting battery 48 to the electrical circuit 32 and supplying energy to light lamps 30. Module 34, including the receiver and its energy source is configured to fit into the goal frame 16. In the absence of positive radio signal, the switch opens, breaking electrical circuit 32. A separate radio transmitter 50 is attuned to the receiver 44 frequency to activate and close switch 46. Hermetically sealed and contained within a moisture-proof housing or enclosure is a miniature radio transmitter 50 including its associated antenna for transmission of a predetermined radio signal. The transmitter 50 is powered by a conventional electrical energy source such as a replaceable dry cell battery (not seen in FIG. 3). The battery is electrically connected to the transmitter 50 activating the transmission of a signal from transmitter 50 which may be detected by the remotely placed radio receiver 44.

Transmitter 50 and receiver 44 are both of common design such as may be found in a conventional remote controlled paging or garage door opening system. Since transmitter 50 is only activated upon scoring a goal, the life of the battery 48 is spared, and therefore transmitter 50 may be reused numerous times. This is an economic advantage.

In the preferred assembly 10, the switch 46, a reed relay switch in the presence of magnet, normally is open and thus inhibits energization of the circuit 30 and a visual signal. Upon the removal of the magnet from the proximity of the reed switch on receipt of a transmitted signal from transmitter 50 the switch closes and the circuit 30 is energized and lamps 32 lit.

Figure 5:
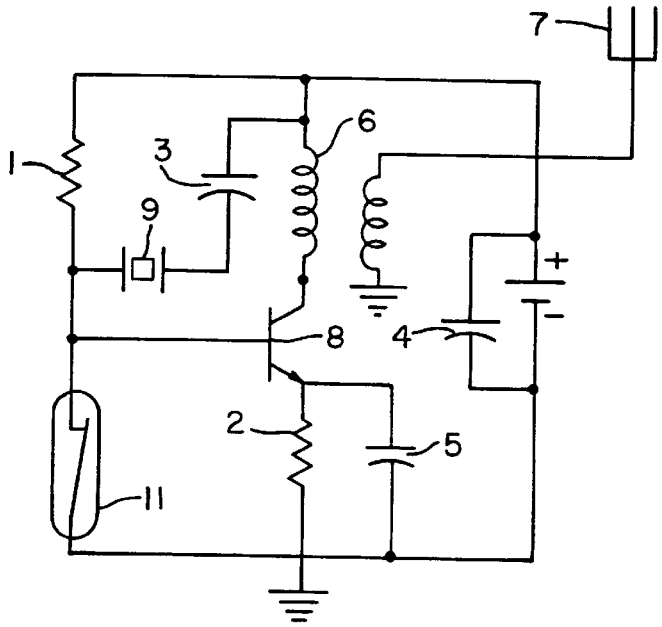
FIG. 5 is an electrical schematic diagram of an embodiment radio transmitter circuit.

FIG. 5 is a schematic diagram of an embodiment radio transmitter circuit which is advantageously used in the assembly 10 of FIG. 1. The following components may be utilized in its construction: resistor 1, 47 k ohm; resistor 2, 560 ohm; capacitor 3, 36 pf; capacitors 4, 5, 1000 pf; battery 1.5 volt, S-13 Eveready battery; transformer 6 subminiature, 16 turn (capacitor 3 side), 2 turn (antenna 7 side); transistor 8, MMT 74, Motorola; switch 11, reed switch, mini-25-11S, Hamlin; quartz crystal 9, 49.850 MHz, SC-45, Sentry Manufacturing Co., Chickasha, Okla.

The assembly 10 is operated as follows: When a player scores a goal by delivering a puck into the mouth 18 of goal assembly 10, an official transmits a radio signal from transmitter 50. The receiver 44 closes switch 46 to energize the circuit 32, lighting lamps 30. The spectator sees the goal indication by the light emitting through apertures 36 in the frame 12. The lamps 30 may, by design, be made to flash periodically or remain continuously lit until the official halts the radio signal transmission.

The apertures 36 in the frame 12 are most numerous on the "face" side of the frame 12, but may also be found on the outside and back sides, alternating, so that the goal indicator can be viewed by spectators in the crowd at the game as well as the TV audience.

In a preferred embodiment assembly 10 of the invention, in the upper corners of the goal mouth 18 are two pairs of lights which indicate to officials the possibility that the goal 10 has slipped off of its positional pins 28.

Two pins 28 have been placed in the rink surface (or ice) that anchor the goal 10 when it is placed on them. When the goal is securely on the pins 28 a pressure switch located at the base of each leg provides power to the green light in the upper corner of the front frame 12. If the net is knocked off the pins 28, the switch closes, lighting an amber light, indicating to officials that play should be halted until the goal has been properly repositioned and anchored.

The red, goal-indicating lights (see FIG. 2) will not operate while the amber light is on.

While the above description is of a single goal-frame assembly, those skilled in the art will appreciate that 2 goals are employed in play, one at each end of the playing field. The 2 goals may be identical in construction, but preferably the means for activating the signal system for each assembly will operate on different radio frequencies, so that only one of the 2 assemblies in use will activate at a given time.

In addition, alternatively to using colored lamps, a colored lens can be placed between lamp 30 and aperture 36.

What is claimed is:

1. A regulation size, score indicating, hockey goal assembly, which comprises;

an open frame defining the goal opening and having an inverted "U" shape with a cross-bar between two downwardly projecting, parallel legs;

the parallel legs each having a first end and a second end, the first ends being integral to the cross-bar and second ends integral to means for support on a ground surface;

means for support on a ground or ice surface;

said frame housing television viewable signal means for indicating a goal scored; and means for activating the signal means comprising a radio signal receiver connected to the signal means and a radio signal transmitter.

2. The assembly of claim 1 wherein the signal means comprises a plurality of electric lamps.

3. The assembly of claim 2 wherein the electric lamps are selected from the group consisting of halogen lamps and strobe lamps.

4. The assembly of claim 2 wherein a fresnel lens is positioned over the electric lamps to enhance light projection.

5. The assembly of claim 4 wherein the light is red colored.

6. A regulation size, score indicating, hockey goal assembly, which comprises;

an open frame defining the goal opening and having an inverted "U" shape with a cross-bar between two downwardly projecting, parallel legs;

the parallel legs each having a first end and a second end, the first ends being integral to the cross-bar and the second ends integral to means for support on a around surface;

means for support on a ground or ice surface;

said frame housing television viewable signal means for indicating a goal scored;

means for activating the signal means;

anchor pins securing the assembly to the ground or ice surface; and a pressure switch mounted on the means for support and the switch is operated by removal of the anchor.

7. The assembly of claim 6 wherein the removal of the anchor closes the switch to energize electrical lamps.

* * * * *